US005656892A

United States Patent [19]

Zimlich et al.

[11] Patent Number: 5,656,892

[45] Date of Patent: Aug. 12, 1997

[54] FIELD EMISSION DISPLAY HAVING EMITTER CONTROL WITH CURRENT SENSING FEEDBACK

[75] Inventors: David A. Zimlich; Glen E. Hush, both of Boise, Id.

[73] Assignee: Micron Display Technology, Inc., Boise, Id.

[21] Appl. No.: 559,912

[22] Filed: Nov. 17, 1995

[51] Int. Cl.[6] ..... H05B 37/02; H01J 19/24

[52] U.S. Cl. ..... 315/169.3; 315/307; 345/212

[58] Field of Search ..... 315/307, 169.3, 315/169.4, 169.1, 336; 345/204, 211, 212, 215; 313/308, 309, 336

[56] References Cited

U.S. PATENT DOCUMENTS

| | | | |
|---|---|---|---|
| 3,970,887 | 7/1976 | Smith et al. | 313/309 |
| 4,810,934 | 3/1989 | Shimoda et al. | 315/107 |
| 4,940,916 | 7/1990 | Borel et al. | 313/306 |
| 5,162,704 | 11/1992 | Kobori et al. | 315/349 |
| 5,186,670 | 2/1993 | Doan et al. | 445/24 |
| 5,210,472 | 5/1993 | Casper et al. | 315/349 |
| 5,212,426 | 5/1993 | Kane | 315/169.1 |
| 5,283,500 | 2/1994 | Kochanski | 315/58 |
| 5,359,256 | 10/1994 | Gray | 313/169 |
| 5,404,081 | 4/1995 | Kane et al. | 315/169.1 |

FOREIGN PATENT DOCUMENTS

| | | | |
|---|---|---|---|
| 9205571 | 4/1992 | WIPO | 315/169.4 |

OTHER PUBLICATIONS

Lee, Kon Jiun, "Current Limiting of field Emitter Array Cathodes," Excerpt of Thesis, Georgia Institute of Technology, Aug. 1986, pp. 88–188.

Yokoo, K. et al., "Active Control of Emission Current of Field Emitter Array, Revue Le Vide, les Couches Minces," vol. 271, Mar./Apr. 1994, pp. 58–61.

*Primary Examiner*—Robert Pascal
*Assistant Examiner*—Arnold Kinkead
*Attorney, Agent, or Firm*—Seed and Berry LLP

[57] ABSTRACT

A field emission display includes an emitter driving circuit for providing current to emitters in the display. The emitter driving circuit includes a current mirror to monitor actual current to each pixel in the array. The actual current is then compared to a reference current derived from an image signal based upon an expected current draw of the emitter to produce an error signal. The error signal is fed back to the input of the emitter driver circuit and the emitter driver circuit produces a corrected emitter current in response. During transitions in the image signal, error detection is briefly disabled to allow the emitter driver circuit to respond to the image signal.

22 Claims, 1 Drawing Sheet

FIELD EMISSION DISPLAY HAVING EMITTER CONTROL WITH CURRENT SENSING FEEDBACK

DESCRIPTION

This invention was made with government support under Contract No. DABT-63-93-C-0025 by Advanced Research Projects Agency (ARPA). The government has certain rights to this invention.

TECHNICAL FIELD

The present invention relates to field emission displays, and more particularly to emitter control circuits in field emission displays.

BACKGROUND OF THE INVENTION

Flat panel displays are widely used in a variety of applications, including computer displays. One type of device suited for such applications is the field emission display. Field emission displays typically include a generally planar substrate having an array of projecting emitters. In many cases, the emitters are conical projections integral to the substrate. Typically, the emitters are grouped into emitter sets where the base of the emitters are commonly connected. A conductive extraction grid is positioned above the emitters and driven with a voltage of about 30 V–120 V. The emitter sets are then selectively activated by coupling the bases to ground. Grounding the emitter sets creates electric fields between the extraction grid and the emitters of sufficient intensity to extract electrons from the emitters and also provides a current path between the emitters and ground.

The field emission display also includes a display screen mounted adjacent the substrate. The display screen is formed from a glass plate coated with a transparent conductive material to form an anode biased to about 1–2 kV. A cathodoluminescent layer covers the exposed surface of the anode. The emitted electrons are attracted by the anode and strike the cathodoluminescent layer causing the cathodoluminescent layer to emit light at the impact site. The emitted light then passes through the glass plate and the anode where it is visible to a viewer.

The brightness of the light produced in response to the emitted electrons depends, in part, upon the rate at which electrons strike the cathodoluminescent layer, which in turn depends upon the magnitude of current. The brightness of each area can thus be controlled by controlling the current flow to the respective emitter set. By selectively controlling the current flow to the emitter sets, the light from each area of the display can be controlled and an image can be produced. The light emitted from each of the areas thus becomes all or part of a picture element or "pixel."

Typically, current flow to the emitter sets is controlled by controlling the voltage applied to the bases of the emitter sets to produce a selected voltage differential between the emitters and the extraction grid. The electric field intensity between the emitters and the extraction grid is then the voltage differential divided by the distance between the emitters and the extraction grid. The magnitude of the current to the emitter set corresponds to the intensity of the electric field.

One problem with the above-described approach is that the response of emitter sets to applied grid and emitter voltages may be non-uniform. Typically, this is caused by variations in the separation between the emitters and the extraction grid across the array, which causes differences in the electric field intensity for a given voltage difference. Often these variations result from variations in the diameter of apertures into which the emitters project, which in turn, are caused by processing variations. For a given voltage differential between the emitters and the extraction grid, the brightness of emitted light may vary according to the location of the emitters.

SUMMARY OF THE INVENTION

A field emission display for displaying an image in response to an image signal includes an array of emitters surrounded by an extraction grid and controlled by an emitter driver circuit. The emitter driver circuit establishes the current available to the emitters to control the emission of electrons from the emitters. The emitted electrons travel from the emitters through the extraction grid toward a transparent conductive anode at a much higher voltage than the voltage of the extraction grid. Electrons traveling toward the anode strike a cathodoluminescent layer causing light to be emitted at the impact site. Because the brightness of the light depends upon the rate at which electrons are emitted by the emitters, the emitter driver circuit controls the brightness of the light by controlling the current flow to the emitters.

In the preferred embodiment, the emitter driver circuit includes an amplifier as its principal gain component. The amplifier receives an image signal through an adder and establishes an initial emitter current in response. The emitter driver circuit also includes a current mirror that mirrors the initial emitter current to produce a feedback current. The mirrored emitter current and a reference current are input to a comparator that produces an error signal corresponding to the difference therebetween. The error signal is supplied to the adder where the error signal is subtracted from the image signal to produce a corrected image signal for input to the amplifier. In response to the corrected image signal, the amplifier produces a corrected emitter current.

The emitter driver circuit also includes a transition circuit that responds to an externally generated transition signal to establish initial conditions in response to transitions of the image signal. The transition circuit temporarily disables the feedback of the mirrored current, sets the error signal to zero, and provides a high-capacity current source to address effects of capacitance of the array. A brief time after the transition signal, the transition circuit frees the error voltage, allows the mirror current to be fed back, and disables the current source to allow the feedback to operate.

DETAILED DESCRIPTION OF THE INVENTION

Figure 1:
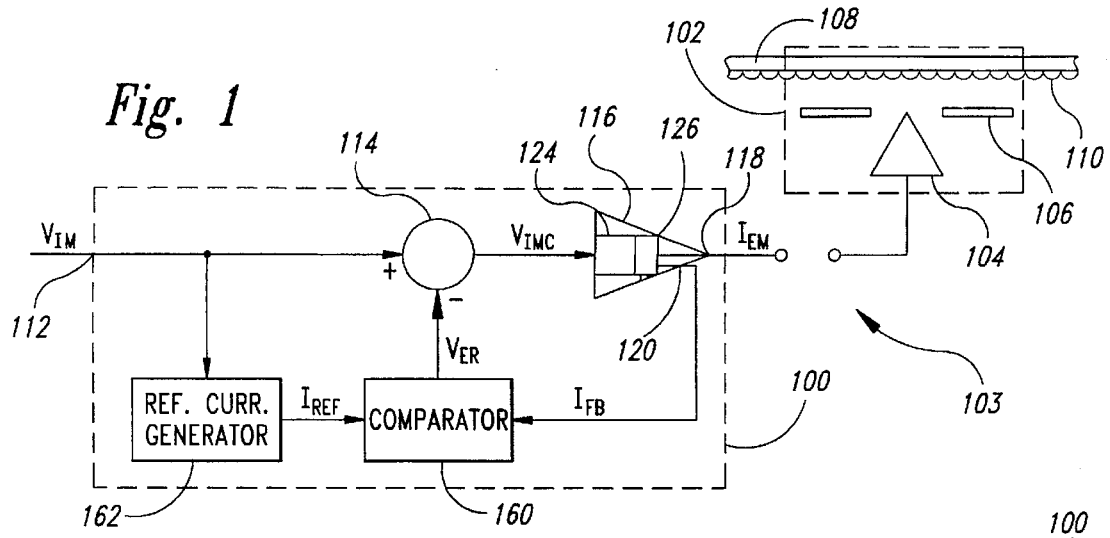
FIG. 1 is a block diagram of a preferred embodiment of the invention, including an emitter driver circuit and pixel.

As shown in FIG. 1, an emitter driver circuit 100 is connected to a display cell 102 in a field emission display 103. The display cell 102 produces one pixel of a displayed image and includes an emitter set aligned with an aperture in an extraction grid 106. The display cell 102 also includes an anode 108 mounted opposite the emitter 104 and extraction grid 106. A cathodoluminescent layer 110 covers the anode 108. Though a single emitter 104 is shown in FIG. 1, it will be understood by one of skill in the art that a set of several emitters 104 can be used to form each pixel.

For clarity of presentation, the following description relates to a monochrome pixel. However, the circuits, structures and methods described herein are also applicable to color displays. In a color display, the emitters 104 in an emitter set are grouped into three groups aligned to respective red, green, and blue portions of the cathodoluminescent layer 110.

The extraction grid 106 is biased to a voltage $V_G$ of about 30–120 V, and the anode 108 is biased to a voltage $V_A$ of about 1–2 kV. If the emitter 104 is coupled to ground, the voltage difference between the extraction grid 106 and the emitter 104 produces an intense electric field between the emitter 104 and the extraction grid 106. The intense electric field causes the emitter set to emit electrons.

The emitted electrons are attracted by the high anode voltage $V_A$ which causes the electrons to travel toward the anode 108. As the electrons travel toward the anode 108, they strike the cathodoluminescent layer 110 causing light to be emitted from the impact site. The brightness of the emitted light depends upon the rate at which electrons strike the cathodoluminescent layer 110 which, in turn, depends upon the current available to the emitter 104. The brightness of the emitted light can thus be controlled by controlling the current flow to the emitter 104.

The emitter driver circuit 100 controls the emitter current $I_{EM}$ in response to an image signal $V_{IM}$ received at an input 112. The image signal $V_{IM}$ is typically a sample of a video signal representing a desired illumination intensity of the display cell 102 forming a pixel. Sampling of the video signal to produce the image signal $V_{IM}$ is performed according to conventional video signal decoding and sampling techniques.

Within the emitter driver circuit 100, the image signal $V_{IM}$ is input to a reference current generator 162 and to an adder 114 that also receives an error signal $V_{ER}$. The development of the error signal $V_{ER}$ and the structure of the adder 102 and reference current generator 162 will be described in greater detail below with respect to FIG. 2.

At the adder 114, the error signal $V_{ER}$ is subtracted from the image signal $V_{IM}$ to provide a corrected image signal $V_{IMC}$. The corrected image signal $V_{IMC}$ is then input to a drive amplifier 116 having a primary output 118 and a feedback output 120. An input section 124 forms the primary gain element of the amplifier 116 and receives the corrected image signal $V_{IMC}$ from the adder 114. A current mirror 126 operates as the output section of the amplifier 116 and provides the emitter current $I_{EM}$ at the primary output 118. As will be discussed below, the current mirror 126 also "mirrors" the emitter current $I_{EM}$ to produce a feedback current $I_{FB}$ at the feedback output 120, such that the feedback current $I_{FB}$ is proportional to the emitter current $I_{EM}$. As mentioned above, the comparator 160 compares the feedback current $I_{FB}$ to a reference current $I_{REF}$ to produce the error signal $V_{ER}$. Because the feedback current $I_{FB}$ corresponds to the actual emitter current $I_{EM}$, and the reference current $I_{FB}$ corresponds to a desired emitter current $I_{DES}$, the error signal $V_{ER}$ indicates difference between the actual emitter current $I_{EM}$ and the reference current $I_{REF}$. The corrected image signal $V_{IMC}$ is thus adjusted at the adder 114 to cause the actual emitter current $I_{EM}$ to approach the reference current $I_{REF}$.

Figure 2:
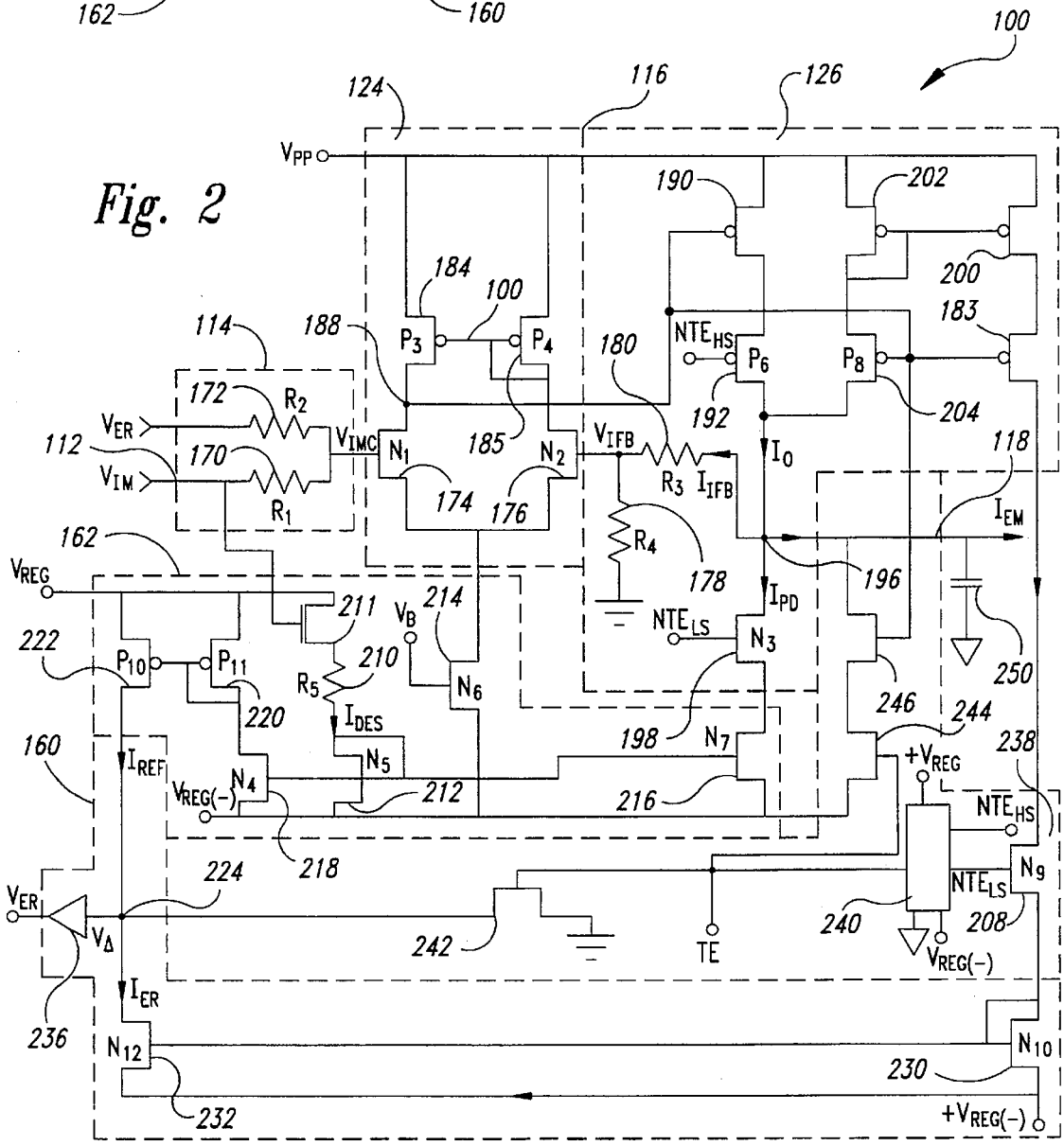
FIG. 2 is a circuit diagram of the emitter driver circuit of FIG. 1.

A preferred circuit for implementing the emitter driver circuit 100 of FIG. 1 is presented in FIG. 2, where corresponding elements are numbered identically. The adder 114 is formed by a simple summing circuit using a pair of resistors 170, 172, each coupled to the input section 124 of the amplifier 116. Because the amplifier 116 has a very high input impedance, the corrected image signal $V_{IMC}$ will correspond to the sum of the image signal $V_{IM}$ and the error signal $V_{ER}$ if the resistances of the resistors 170, 172 are equal. However, since the error signal $V_{ER}$ is inverted (as explained below), the adder functions as a subtracter. As will be discussed below, in steady state, the error signal $V_{ER}$ will equal zero volts such that the corrected image voltage $V_{IMC}$ will be proportional to the image signal $V_{IM}$.

The input section 124 of the amplifier 116 has as its main forward gain element a first NMOS transistor 174 coupled to the supply voltage $V_{PP}$ through a PMOS load transistor 184. The gate voltage of the first NMOS transistor 174 is controlled by the corrected image voltage $V_{IMC}$, so that, for increasing magnitudes of the corrected image signal $V_{IMC}$, the current increases through the first NMOS transistor 174. A constant current transistor 214 controlled by a bias voltage $V_B$ establishes the current draw of the input section 124 at a current $I_{TAIL}$.

The first NMOS transistor 174 is connected to a second NMOS transistor 176 to form a differential input stage. The source of the second transistor 176 is coupled to the supply voltage $V_{PP}$ through a diode-coupled PMOS load transistor 185. The drain of the load transistor 185 is connected to its gate and the gate of the PMOS transistor 184 so that an output voltage is developed at node 188 that is proportional to the differential input voltage applied to the gates of the NMOS transistors 174, 176. The voltage $V_{IFB}$ applied to the gate of the NMOS transistor 176 is established by an internal feedback current $I_{IFB}$ supplied by the current mirror 126 to a voltage divider formed from resistors 178, 180, as will be discussed in greater detail below. In steady state operation, the internal feedback current $I_{IFB}$ is established such that the gate voltages $V_{IMC}$, $V_{IFB}$ are equal and the currents through the NMOS transistors 174, 176 are equal.

Because the drain of the second NMOS transistor 176 is connected to the gate and drain of the load transistor 185, the second NMOS transistor 176 controls the gate and drain voltage of the diode-coupled transistor 185. The gate of the load transistor 185 is connected to the gate of the PMOS transistor 184 so that the gate voltage of the PMOS transistor 184 tracks the gate voltage of the diode coupled PMOS transistor 185. By controlling the current through the load transistor 185, the NMOS transistor 176 establishes the gate to source voltage of the load transistor 185 and thus controls the gate to source voltage of the PMOS transistor 184.

If the current drawn by the second NMOS transistor 176 increases incrementally due to the internal feedback voltage $V_{IFB}$ exceeding the corrected image voltage $V_{IMC}$, the gate to source voltage of the diode-coupled transistor 185 increases incrementally, increasing the gate to source voltage of the PMOS transistor 184. Because the source-to-drain current of the PMOS transistor 184 is equal to the current $I_{TAIL}$ minus the source-to-drain current of the second NMOS transistor 176, the increased current drawn by the second PMOS transistor 176 causes the current through the PMOS transistor 184 to decrease incrementally. To satisfy these conditions ($V_{GS}$ increased, $I_{DS}$ decreased), the source to drain voltage of the PMOS transistor 184 must decrease, thereby increasing the output voltage on node 188.

The increased voltage on the node 188 increases the gate voltage of an opposing PMOS transistor 204, lowering its gate to source voltage. The opposing transistor 204 then draws less current which, neglecting for the present discussion the effects of other components in the current path to the gate of the second NMOS transistor 176, reduces the internal feedback current $I_{IFB}$. This reduces the internal feedback voltage $V_{IFB}$, thereby reducing the difference between the corrected image voltage $V_{IMC}$ and the internal feedback voltage $V_{IFB}$. The lowered internal feedback voltage $V_{IFB}$ lowers the current drawn by the second NMOS transistor 176, thereby allowing the current flow through the first NMOS transistor 174 to increase, until a stable state is reached.

In addition to providing a portion of the internal feedback current $I_{IFB}$, the opposing transistor 204 also acts as the input stage of the current mirror 126, as will now be described. The opposing transistor 204 is coupled to the supply voltage $V_{PP}$, through a diode-coupled mirror transistor 202 to form a current path between the supply voltage $V_{PP}$ and an output node 196. A second pair of PMOS transistors 190, 192 form a parallel path between the supply voltage $V_{PP}$ and the node 196. However, the PMOS transistor 192 is kept off by a transition disable signal NTE, except during transition periods, as discussed below. Therefore, during normal operation, the opposing transistor 204 and diode-coupled transistor 202 form the current path from the supply voltage $V_{PP}$ to the node 196.

As noted above, the opposing transistor 204 is driven by the voltage at the node 188. In response, the opposing transistor 204 provides an output current $I_O$ that is divided at the node 196 to form three different currents. Establishment of the magnitude of the output current $I_O$ will be discussed below. A first portion of the output current $I_O$ becomes the internal feedback current $I_{IFB}$ that flows to the resistor divider formed from the two resistors 178, 180 to produce the internal feedback voltage $V_{IFB}$. A second portion of the output current $I_O$ becomes the emitter current $I_{EM}$. A third and final portion of the output current $I_O$ becomes a pull down current $I_{PD}$ that passes through a gate transistor 198 to the reference current generator 162. As will be discussed below, the pull down current $I_{PD}$ is established by the reference current generator 162 as equaling the reference current $I_{REF}$. The total output current $I_O$ is therefore equal to the sum of the internal feedback current $I_{IFB}$, the emitter current $I_{EM}$, and the reference current $I_{REF}$.

In addition to supplying the output current $I_O$, the opposing transistor 204 and diode-coupled transistor 202 also provide a mechanism through which the output current $I_O$ can be monitored. Because the diode-coupled transistor 202 is serially connected to the opposing transistor 204, the current through the diode-coupled transistor 202 will equal the current through the opposing transistor 204 which, in turn, will equal the output current $I_O$. The current through the diode-coupled transistor 202 establishes the diode-coupled transistor's gate to source voltage which controls the gate to source voltage of a first feedback transistor 200. The channel width and length of the first feedback transistor 200 are matched to the channel width and length of the diode-coupled transistor 202. Therefore, because the gate to source voltages of the diode-coupled coupled transistor 202 and first feedback transistor 200 are equal, the current through the first feedback transistor 200 will attempt to mirror the current through the diode-coupled transistor 202, thereby setting the feedback current $I_{FB}$ equal to the output current $I_O$.

To further ensure accurate mirroring of the current through the opposing transistor 204, a second feedback transistor 183 is serially coupled with the first feedback transistor 200. The gate of the second feedback transistor 183 is commonly coupled with the gate of the opposing transistor 204. Because the voltage drops across the diode-coupled transistor 202 and first output transistor 200 will be substantially equal, the source voltage of the second output transistor 183 will be substantially equal to the source voltage of the opposing transistor 204. Consequently, the second output transistor 183 will try to pass substantially the same current as the opposing transistor 204, further ensuring that the feedback current $I_{FB}$ will equal the output current $I_O$. In addition to ensuring the proper mirroring of the output current $I_O$, the second output transistor 208 provides isolation to prevent variations in the drain voltage of the gate transistor 208 from affecting the drain voltage of the first feedback transistor 200, thereby ensuring that the biasing conditions for the diode-coupled transistor 202 and the first feedback transistor 200 remain substantially the same.

Neglecting for purposes of the present discussion a gating transistor 208 that helps establish initial conditions as discussed below, the feedback current $I_{FB}$ is supplied to the comparator 160. As discussed above, the comparator 160 compares the feedback current $I_{FB}$ to the reference current $I_{REF}$ to produce the error signal $V_{ER}$. Generation of the reference current $I_{REF}$ by the reference current generator 162 will be described before describing the comparison within the comparator 160.

The reference current generator 162 receives the image signal $V_{IM}$ at the gate of an NMOS reference transistor 211 having its drain coupled to the regulated voltage supply $V_{REG}$. The source of the reference transistor 211 is coupled to a regulated negative reference voltage $V_{REG(-)}$ through a limiting resistor 210 and a diode-coupled transistor 212. The parameters of the reference transistor 211 and the value of the resistor 210 are selected such that the reference transistor 211 will draw a desired emitter current $I_{DES}$ corresponding to the desired brightness of the pixel for the applied image signal $V_{IM}$. The desired emitter current $I_{DES}$ establishes the gate to source voltage of the diode-coupled transistor 212 at a voltage corresponding to the magnitude of the image signal $V_{IM}$. Because the gate and source of the transistor 212 are connected to the gates and sources of a control transistor 216 and a reference transistor 218, the gate to source voltage of the transistor 212 establishes the gate to source voltage of each of the transistors 216, 218. Each of the transistors 216, 218 has a channel width and length matched to that of the diode-coupled transistor 212. Thus, the current through each of the transistors 216, 218 will equal the desired emitter current $I_{DES}$ through the diode-coupled transistor 212.

The control transistor 216 sets the pull down current $I_{PD}$ equal to the desired emitter current $I_{DES}$ and the reference transistor 218 sets the current through a diode-coupled PMOS transistor 220 equal to the desired emitter current $I_{DES}$. The gate of the diode-coupled PMOS transistor 220 is connected to the gate of a matching transistor 222, such that the desired emitter current $I_{DES}$ through the PMOS diode-coupled transistor 220 is mirrored by the matching transistor 222 to produce the reference current $I_{REF}$ output from the reference current generator 162. Thus, the desired emitter current $I_{DES}$ and also the currents through each of the transistors 212, 216 are equal to the reference current $I_{REF}$.

Comparison of the feedback current $I_{FB}$ to the reference current $I_{REF}$ will now be described. Within the comparator 160, the feedback current $I_{FB}$ is mirrored and scaled by two-thirds by a mirror transistor 230 and a matching transistor 232 to produce the error current $I_{ER}$ through the matching transistor 232. The error current $I_{ER}$ is therefore:

$$I_{ER}=\tfrac{2}{3}I_{FB}=\tfrac{2}{3}(\tfrac{1}{2}I_O)=\tfrac{1}{3}(I_{GATE}+I_{EM}+I_{IFB})=\tfrac{1}{3}(I_{REF}+I_{ER}+I_{IFB})$$

The values of the resistors 178, 180 are selected such that the internal feedback current $I_{EM}$ is substantially equal to the reference current $I_{REF}$. Thus, if the emitter current $I_{EF}$ equals the reference current $I_{REF}$, the error current $I_{ER}$ will be $I_{ER}=\frac{1}{3}(3I_{REF})=I_{REF}$. If, on the other hand, the emitter current $I_{EM}$ is greater or less than the reference current $I_{REF}$, the error current $I_{ER}$ will be correspondingly greater or less than the reference current $I_{REF}$.

The comparator 160 can therefore identify differences between the emitter current $I_{EM}$ and the desired emitter current $I_{DES}$ by comparing the error current $I_{ER}$ to the reference current $I_{REF}$. The comparator 160 compares the error current $I_{ER}$ to the reference current $I_{REF}$ by coupling the source of the matching transistor 222 and the source of the matching transistor 232 to a common node 224. The channel widths and lengths of the matching transistors 222, 232 are matched such that, for equal currents, the voltage drop across the transistors 222, 232 will be equal. Because the source voltage of the matching transistor 222 is equal to and opposite from the source voltage of the matching transistor 232, the node 224 will be at zero volts when the currents $I_{REF}$, $I_{ER}$ are equal. If the currents $I_{REF}$, $I_{ER}$ are not equal, the node 224 will shift away from zero volts. Because the voltage at the node 224 indicates the error between the emitter current $I_{EM}$ and the reference current $I_{REF}$, the node voltage provides the error signal $V_{ER}$ that is input to the adder 114 through a buffer amplifier 236. As noted above, variations in the error voltage $V_{ER}$ cause corresponding shifts in the corrected image signal $V_{IMC}$ that cause changes in the output current $I_O$ that, in turn, cause corrections to the emitter current $I_{EM}$. At steady state, these corrections cause the emitter current $I_{EM}$ to remain substantially equal to the reference current $I_{REF}$.

To improve the response time of the emitter driver circuit 100 to transitions in the magnitude of the image signal $V_{IM}$, a transition circuit 238 briefly disables feedback and sets the error signal $V_{ER}$ to zero during transitions. The transition circuit 238 is driven principally by an externally generated transition enable signals TE $NTE_{HS}$, $NTE_{LS}$. Typically, the transition enable signal TE is a high-going pulse derived from a row clock signal, such that, during transitions of the image signal $V_{IM}$, the transition enable signal TE is high for a brief transitional period. A level translator 240 produces the transition disable signals $NTE_{HS}$, $NTE_{LS}$. The transition disable signals $NTE_{HS}$, $NTE_{LS}$ are high and low voltages, respectively, that are the inverse of the transition enable signal TE. The level translator 240 provides the low transition disable signal $NTE_{LS}$ to the gate transistor 208 such that when the transition enable signal TE goes high, the gate transistor 208 turns OFF and the feedback current $I_{FB}$ is blocked. At the same time, the high transition disable signal $NTE_{HS}$ turns ON the PMOS transistor 192 allowing the PMOS transistor 190 to supplement the current supplied by the opposing transistor 204 to the node 196. The transition enable signal TE goes high and turns ON a reference transistor 242 to couple the node 224 to ground. The node voltage is thus zero, setting the error voltage $V_{ER}$ to zero.

Because the feedback is disabled and the error signal $V_{ER}$ is zeroed, the gate of the first NMOS transistor 174 is driven directly by the image signal $V_{IM}$ as proportioned by the resistors 170, 172. The input section 112 and current mirror 126 then supply emitter current $I_{EM}$ without regard to errors between the emitter current $I_{EM}$ and the desired emitter current $I_{DES}$. This allows the driving circuit 100 to rapidly provide current in excess of the desired emitter current $I_{DEM}$ during transition to overcome capacitance effects (represented as a capacitor 250) of conductive lines within the array to establish initial conditions during the transition period. This allows the amplifier 116 to vary the emitter current $I_{EM}$ quickly in response to changes in the image signal $V_{IM}$.

To further improve the response of the emitter driver circuit 100 during the transitional period, the transition circuit 238 also includes a pair of NMOS boost transistors 244, 246 coupled between the node 196 and the negative reference voltage $V_{REG(-)}$. The lower boost transistor 244 is operated as a switch activated by the transition enable signal TE, such that current can flow only when the transition enable signal TE is high. At the same time, the low transition disable signal $NTE_{LS}$ turns OFF the gate transistor 198 so that no current flows through the control transistor 216. In essence, the gate transistor 198 and lower boost transistor 244 "switch" control of current from the control transistor 216 to the upper boost transistor 246 during transitions. The gate of the upper boost transistor 246 is commonly connected with the gates of the PMOS output transistor 192 and the opposing transistor 204 such that the upper boost transistor 246 is controlled by the voltage of the node 188. During transitions, the first NMOS transistor 174 directly controls the upper boost transistor 246 to produce a controlled current path between the primary output 118 and the negative reference voltage $V_{REG(-)}$. This provides a low resistance path to sink current from the primary output 118 to help overcome the capacitance effects described above. After the transitional period, the transition enable signal TE returns low and the transition disable signals $NTE_{HS}$, $NTE_{LS}$ return high. The reference transistor 242 and the lower boost transistor 244 turn OFF and the gate transistor 208 and the PMOS transistor 192 turn ON. The feedback described above is reactivated and errors in the emitter current $I_{EM}$ are corrected to seek a stable condition.

While the invention has been presented herein by way of an exemplary embodiment, equivalent structure may be substituted for the structures described here and perform the same function in substantially the same way and fall within the scope of the present invention. The invention is therefore described by the claims appended hereto and is not restricted to the embodiments shown herein.

We claim:

1. A field emission display for displaying an image in response to an image signal, comprising:

an array of display cells;

emitter set including a plurality of emitters, the emitter set corresponding to one of the display cells in the array; and an emitter driver circuit coupled the emitter set to provide an emitter current to the emitter set in response to the image signal, the emitter driver circuit including a current monitor coupled to monitor the emitter current, the current monitor producing a monitor signal corresponding to the monitored emitter current, wherein the current monitor is a current mirror coupled to produce a feedback current proportional to the emitter current such that the feedback current forms the monitor signal.

2. The field emission display of claim 1 wherein the emitter driver circuit further includes:

a reference source providing a reference signal corresponding to a target emitter current; and a comparator connected to receive the monitor signal and the reference signal, the comparator producing an error signal in response to the monitor signal and the reference signal.

3. The field emission display of claim 2 wherein the emitter driver circuit further includes an error input coupled to receive the error signal from the comparator, the emitter driver circuit being responsive to correct the emitter current in response to the error signal.

4. The field emission display of claim 3 wherein the emitter driver circuit includes a first transistor connected to supply the emitter current in response to the image signal and the current mirror includes a second transistor opposing the first transistor and connected to produce the monitor current proportional to the emitter current provided by the first transistor.

5. The field emission display of claim 4 wherein the reference source includes a reference input coupled to receive the image signal, the reference source producing the reference signal in response to the image signal.

6. The field emission display of claim 2, further including:

a transition circuit having a signal input for receiving a transition signal, the transition circuit being coupled to block the emitter driver circuit from responding to the error signal during a transition period following the transition signal.

7. The field emission display of claim 6 wherein the transition circuit includes a boost circuit connected to establish initial conditions for the emitter set at the end of the transition period.

8. A current stabilized emitter driver circuit for controlling a portion of a field emission display in response to an image signal, the field emission display having an array of emitters, comprising:

an emitter current source coupled to one of the emitters, the emitter current source having a driving signal input for receiving the image signal and an error signal input for receiving an error signal, the emitter current source providing an emitter current corresponding to the image signal and the error signal;

a current monitor coupled to monitor the emitter current provided to the emitter set by the emitter current source, the current monitor producing a monitor signal in response thereto, the current monitor including a current mirror;

a reference source providing a reference signal corresponding to a desired emitter current; and a comparator connected to receive the monitor signal and the reference signal, the comparator producing the error signal in response to the monitor signal and the reference signal, the comparator further being coupled to provide the error signal to the error signal input.

9. The emitter driver circuit of claim 8 wherein the emitter current source includes a first transistor connected to supply the emitter current in response to the image signal at the driving signal input and the current mirror includes a second transistor opposing the first transistor and connected to provide a current proportional to the emitter current in response to the image signal.

10. The emitter driver circuit of claim 9 wherein the reference signal source includes a reference input coupled to receive the image signal, the reference signal source producing the reference signal in response to the image signal.

11. The emitter driver circuit of claim 10, further including:

a transition circuit having a signal input for receiving a transition signal, the transition circuit being coupled to block the emitter current source from responding to the error signal during a transition period following the transition signal.

12. The emitter driver circuit of claim 11 wherein the transition circuit includes a boost circuit connected to establish initial conditions for the emitter set at the end of the transition period.

13. A method of providing a stabilized emitter current to an emitter set in a field emission display:

providing an initial emitter signal to the emitter set with an emitter driver circuit;

monitoring current induced in the emitter set by the initial emitter signal;

establishing a desired emitter current;

comparing the monitored current to the desired emitter current to determine a current error;

producing a transition signal during a transitional period;

inhibiting the feeding back of the error signal during the transitional period in response to the transition signal; and adjusting the initial emitter signal to reduce the current error.

14. The method of claim 13 wherein the emitter driver circuit includes a control input and the step of comparing the monitored current to the desired emitter current includes producing an error signal corresponding to the current error with a comparator; and the step of adjusting the initial emitter signal to reduce the current error includes the step of feeding back the error signal from the comparator to the control input of the emitter drive circuit to cause the initial emitter signal to change.

15. The method of claim 14 wherein the step of providing the initial emitter signal to the emitter set with the emitter driver circuit includes the steps of:

receiving an image signal with the emitter driver circuit; producing with the emitter driver circuit the initial emitter signal in response to the image signal; and applying the initial emitter signal to the emitter set.

16. The method of claim 15 wherein the step of establishing a desired emitter current includes the steps of:

receiving the image signal with a reference current generator; and producing the desired emitter current with the reference current generator in response to the image signal.

17. The method of claim 13 wherein the step of monitoring the current induced in the emitter set includes the step of mirroring the current induced in the emitter set with a current mirror.

18. A method of providing a stabilized emitter current to an emitter set in a field emission display:

providing an initial emitter signal to the emitter set with an emitter driver circuit;

monitoring current induced in the emitter set by the initial emitter signal by mirroring the current induced in the emitter set;

establishing a desired emitter current;

comparing the monitored current to the desired emitter current to determine a current error; and adjusting the initial emitter signal to reduce the current error.

19. The method of claim 18 wherein the emitter driver circuit includes a control input and the step of comparing the monitored current to the desired emitter current includes producing an error signal corresponding to the current error with a comparator; and the step of adjusting the initial emitter signal to reduce the current error includes the step of feeding back the error signal from the comparator to the control input of the emitter drive circuit to cause the initial emitter signal to change.

20. The method of claim 18 wherein the step of providing the initial emitter signal to the emitter set with the emitter driver circuit includes the steps of:

receiving an image signal with the emitter driver circuit;

producing with the emitter driver circuit the initial emitter signal in response to the image signal; and applying the initial emitter signal to the emitter set.

21. The method of claim 20 wherein the step of establishing a desired emitter current includes the steps of:

receiving the image signal with a reference current generator; and producing the desired emitter current with the reference current generator in response to the image signal.

22. The method of claim 18 further including the steps of:

producing a transition signal during a transitional period; and inhibiting the feeding back of the error signal during the transitional period in response to the transition signal.

* * * * *